US011524861B2

(12) United States Patent
Tomatsu

(10) Patent No.: US 11,524,861 B2
(45) Date of Patent: Dec. 13, 2022

(54) PRINTING APPARATUS

(71) Applicant: BROTHER KOGYO KABUSHIKI KAISHA, Nagoya (JP)

(72) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/120,943

(22) Filed: Dec. 14, 2020

(65) Prior Publication Data

US 2021/0179378 A1 Jun. 17, 2021

(30) Foreign Application Priority Data

Dec. 16, 2019 (JP) ..... JP2019-226839

(51) Int. Cl.
*B65H 20/02* (2006.01)
*B41J 15/04* (2006.01)

(52) U.S. Cl.
CPC ..... *B65H 20/02* (2013.01); *B41J 15/046* (2013.01); *B65H 2404/143* (2013.01); *B65H 2404/144* (2013.01); *B65H 2404/1421* (2013.01); *B65H 2404/1451* (2013.01); *B65H 2404/14212* (2013.01); *B65H 2801/06* (2013.01)

(58) Field of Classification Search
CPC ..... B65H 20/02; B65H 2404/1421; B65H 2404/143; B65H 2404/1451; B65H 2801/06; B65H 2404/14212; B65H 2404/144; B41J 15/046
See application file for complete search history.

(56) References Cited

U.S. PATENT DOCUMENTS 6,263,176 B1 * 7/2001 An ..... G03G 15/161 399/101
9,403,381 B2 * 8/2016 Kondo ..... B65H 85/00
2007/0147919 A1 * 6/2007 Lim ..... G03G 15/6511 399/388
2015/0165801 A1 6/2015 Murata et al.

FOREIGN PATENT DOCUMENTS

JP H7-20996 Y 5/1995
JP 2005089099 A * 4/2005 ..... B65H 9/14
JP 2015-112837 A 6/2015

* cited by examiner

*Primary Examiner* — Yaovi M Ameh
(74) *Attorney, Agent, or Firm* — Scully, Scott, Murphy & Presser, PC

(57) ABSTRACT

There is provided a printing apparatus including: a recorder; first and second conveying rollers; a first member which includes the first conveying roller and in which the first conveying roller is supported shakably; and a second member which includes the second conveying roller. The first member includes: a roller support having: an extending part which extends in an extending direction of a rotation shaft of the first conveying roller, and first and second supports which rotatably supports first and second ends of the rotation shaft of the first conveying roller, respectively; and at least one pressing part configured to press a central area of the extending part in a pressing direction extending from the first conveying roller to the second extending roller, in a state that the first and second conveying rollers are brought into contact with each other.

15 Claims, 11 Drawing Sheets

PRINTING APPARATUS

CROSS REFERENCE TO RELATED APPLICATION

The present application claims priority from Japanese Patent Application No. 2019-226839, filed on Dec. 16, 2019, the disclosure of which is incorporated herein by reference in its entirety.

BACKGROUND

The present disclosure relates to a printing apparatus.

Japanese Patent Application Laid-open No. 2015-112837 discloses that an external cover which is rotatably attached to a main body of a printing apparatus is opened so that a forward (leading) end of a sheet drawn from a roll body is set in the printing apparatus.

SUMMARY

In the printing apparatus disclosed in Japanese Patent Application Laid-open No. 2015-112837, a pair of conveying rollers which convey the sheet is held in the main body of the printing apparatus and is not attached to the external cover. For example, in a case that one of the pair of conveying rollers is provided on the external cover, a conveying roller which is included in the pair of conveying rollers and which is held by external cover needs to be positioned highly precisely with respect to another conveying roller which is included in the pair of conveying rollers and which is held by the main body of the printing apparatus in a state that the external cover is closed. In addition, it is preferred to apply a pressing force (pushing force) uniformly from the conveying roller held by the external cover to the conveying roller held by the main body of the printing apparatus.

It is an object of the present disclosure to provide a printing apparatus which is capable of conveying a sheet by a conveying roller(s) with high accuracy.

According to an aspect of the present disclosure, there is provided a printing apparatus including:

a recorder configured to record an image on a sheet;

a first conveying roller and a second conveying roller configured to convey the sheet to the recorder while pinching the sheet therebetween;

a first member which includes the first conveying roller and in which the first conveying roller is supported shakably; and a second member which includes the second conveying roller, wherein the first member includes:

a roller support having:

an extending part which extends in an extending direction of a rotation shaft of the first conveying roller, a first support which rotatably supports a first end of the rotation shaft of the first conveying roller, at a first end of the extending part, a second support which rotatably supports a second end of the rotation shaft of the first conveying roller, at a second end of the extending part; and at least one pressing part configured to press a central area of the extending part in a pressing direction extending from the first conveying roller to the second extending roller, in a state that the first conveying roller and the second conveying roller are brought into contact with each other.

According to the above-described configuration, it is possible to reduce any unevenness or variation which might be generated in a pressing force of the first conveying roller toward the second conveying roller. Therefore, the printing apparatus is capable of conveying a sheet from the first conveying roller and the second conveying roller to the liquid discharging head, with high precision.

EMBODIMENTS

First Embodiment

<Overview of Printing Apparatus 1>

Figure 1:
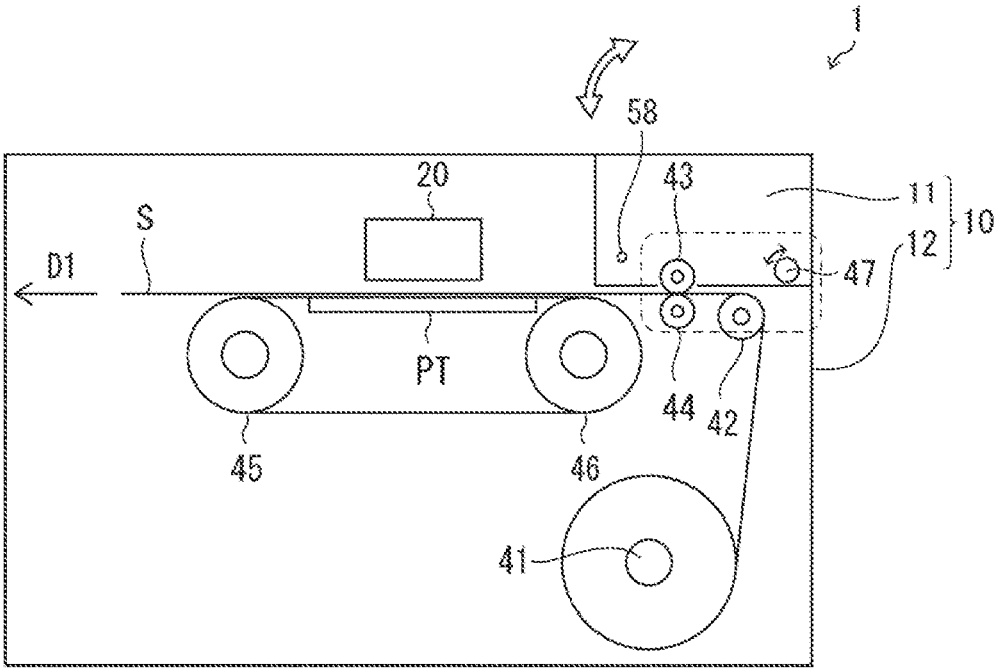
FIG. 1 is a schematic view depicting the configuration of a printing apparatus according to first embodiment.

FIG. 1 is a schematic view depicting the configuration of a printing apparatus 1 related to a first embodiment of the present disclosure. As depicted in FIG. 1, the printing apparatus 1 is a label printer of the ink-jet printing system. The Printing apparatus 1 includes a casing 10 and a liquid discharging head 20. A printing apparatus 1 is an apparatus which discharges or ejects a liquid from the liquid discharging head 20 onto a sheet S and fixes the liquid to the sheet S.

As the sheet S, a variety of kinds of materials in the form of sheet are used. For example, paper, cloth, resin, nonwoven paper, wood, ceramic, semiconductor, metal, glass, etc., or a composite thereof are used as the sheet S. The form of the sheet includes not only forms referred to simply as sheet, but also forms referred to as paper, seal (label, sticker), plate, foil, wafer, substrate, disc, film and panel.

The casing 10 is an external member in which the respective members are housed or accommodated. The casing 10 includes a lid part 11 and a main body part 12. The lid part 11 is connected to the main body part 12 via a rotation axis 47 and is connected to the main body part 12 to be rotatable with respect to the main body part 12. As a result, the lid part 11 is configured to be openable/closable with respect to the main body part 12. In a case that the lid part 11 is opened with respect to the main body part 12, a pressure roller 43 moves together with the lid part 11.

The liquid discharging head 20 is an example of a "recorder" which records an image on the sheet S by ejecting or discharging the liquid to the sheet S. In a case that the printing apparatus 1 is an image forming apparatus of the ink-jet system, the liquid discharging head 20 is a recording head which ejects the ink, and an image is formed on the sheet S by fixation of the ink.

In addition to this, the printing apparatus 1 includes an install shaft 41, a roller 42, a pressure roller 43 and a driving roller 44. The sheet S is installed in the install shaft 41 and is unwound (unreeled out) from the install shaft 41. The sheet S is conveyed, via the roller 42, in a conveying direction D1 by being held or pinched between the pressure roller 43 and the driving roller 44. In other words, the pressure roller 43 and the driving roller 44 are configured to convey the sheet S to the liquid discharging head 20 while pinching the sheet S therebetween. The pressure roller 43 is an example of a "first conveying roller", and the driving roller 44 is an example of a "second conveying roller".

Further, the printing apparatus 1 also includes a platen PT, and rollers 45 and 46. The platen PT is arranged in the inside of the casing 10 so as to face the liquid discharging head 20. The platen PT is a member configured to support the sheet S. As the sheet S is (being) conveyed on the platen PT by the rollers 45 and 46, the liquid is ejected from the liquid discharging head 20 onto a surface of the sheet S.

<Peripheral Structure of Pressure Roller 43 and Driving Roller 44>

Figure 2:
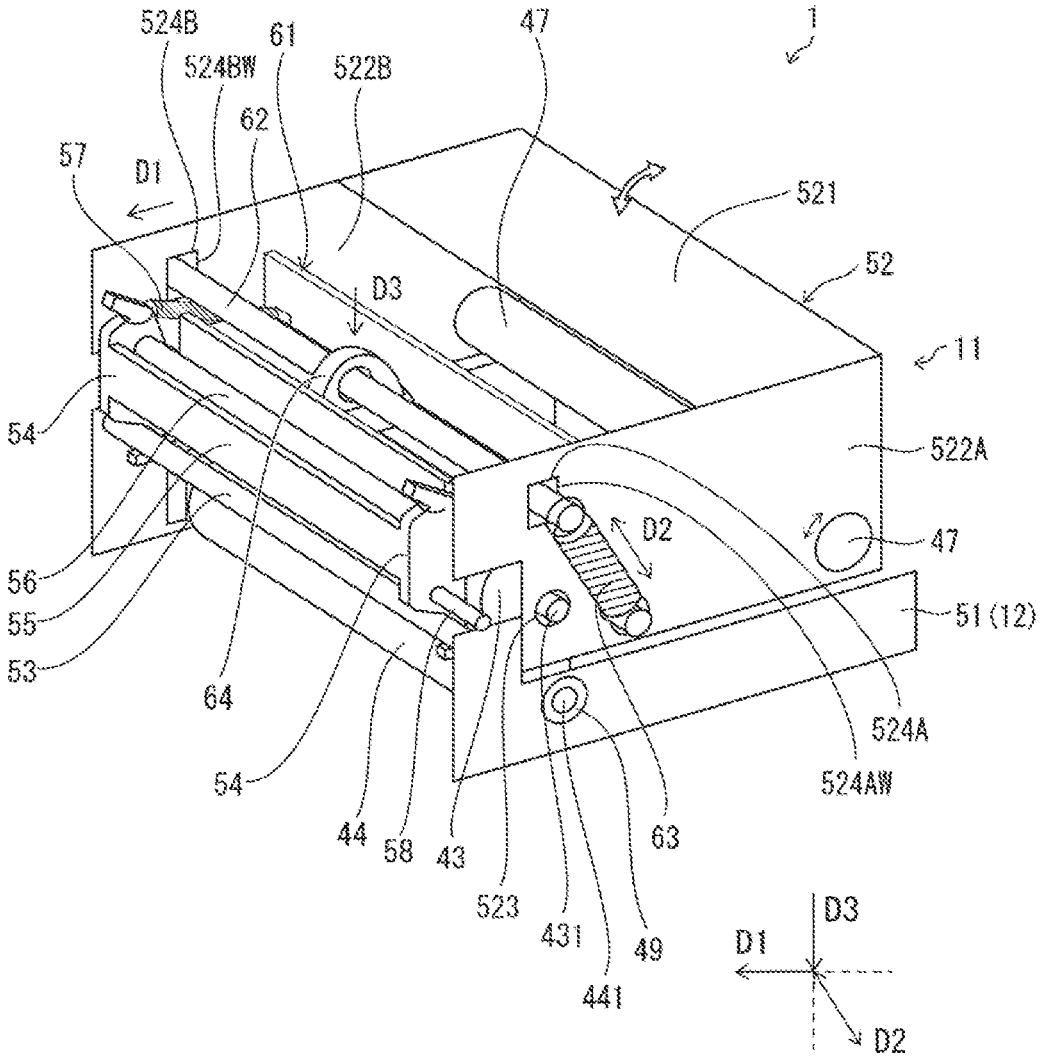
FIG. 2 is a perspective view depicting an example of the peripheral structure of a pressure roller and a driving roller.
Figure 3:
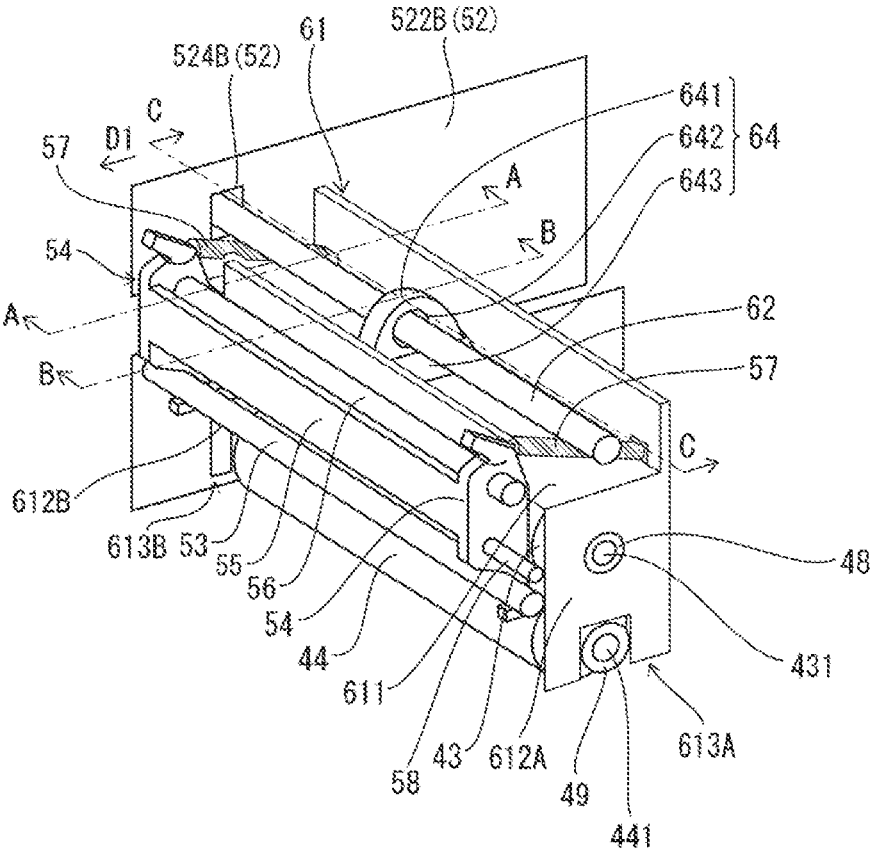
FIG. 3 is a perspective view depicting the example of the peripheral structure of the pressure roller and the driving roller.

FIG. 2 is a perspective view depicting an example of the peripheral structure of the pressure roller 43 and the driving roller 44 in an area surrounded by a dashed line in FIG. 1. FIG. 3 is a perspective view depicting an example of the peripheral structure of the pressure roller 43 and the driving roller 44 in a case that the configuration of a base part frame 51 and a part of a rotary frame 52, etc., in FIG. 2 are cut out so that the above-described peripheral structure can be seen.

<Base Part Frame 51, Rotary Frame 52, Pressure Roller 43, and Driving Roller 44>

As depicted in FIG. 2, the printing apparatus 1 includes a base part frame 51 and a rotary frame 52. The base part frame 51 is provided on the main body part 12 depicted in FIG. 1 so as to rotatably support the driving roller 44. That is, the main body part 12 is an example of a "second member" including the driving roller 44. The rotary frame 52 is provided on the lid part 11 depicted in FIG. 1 and supports a roller supporting part 61 which rotatably supports the pressure roller 43. That is, the lid part 11 is an example of a "first member" including the pressure roller 43 and the roller supporting part 61. As depicted in FIG. 2, the rotation shaft 47 is connected to the rotary frame 52, and the rotary frame 52 swings together with the lid part 11, accompanying with the rotation of the rotation shaft 47. That is, the position of the driving roller 44 is fixed, and the pressure roller 43 moves, together with rotary frame 52, relative to the driving roller 44.

Note, however, that the pressure roller 43 may be connected to the base part frame 51 and that driving roller 44 may be connected to the rotary frame 52 via the roller supporting part 61. In such a case, the position of the pressure roller 43 is fixed, and the driving roller 44 moves, together with the rotary frame 52, relative to the pressure roller 43. Further, in such a case, the driving roller 44 is an example of the "first conveying roller", and the pressure roller 43 is an example of the "second conveying roller".

As depicted in FIG. 2, a rotating shaft 441 of the driving roller 44 is connected to the base part frame 51 via a bearing 49. The bearing 49 is provided on each of the both ends of the rotating shaft 441 of the driving roller 44.

As depicted in FIG. 2, the rotary frame 52 is an example of a "frame" including an upper surface part 521, a first side surface part 522A and a second side surface part 522B.

The rotary frame 52 shakably or rockably supports the pressure roller 43 so that the pressure roller 43 can shake or rock with respect to the rotary frame 52. Specifically, as depicted in FIG. 2, a pressure roller-hole part 523 through which one end of the rotating shaft 431 of the pressure roller 43 penetrates is provided, as an example of a "third hole", in the first side surface part 522A. Also in the second side surface part 522B, a pressure roller-hole part 523 through which the other end of the rotating shaft 431 of pressure roller 43 penetrates is provided as an example of a "fourth hole". The pressure roller-hole part 523 provided in each of the first side surface part 522A and the second side surface part 522B is greater than the cross-section of the rotating shaft 431 of the pressure roller 43. That is, the first side surface part 522A is an example of a "first part" which movably supports the one end of the rotation shaft of the pressure roller 43, and the second side surface part 522B is an example of a "second part" which movably supports the other end of the rotation shaft of the pressure roller 43.

The relative position between the pressure roller 43 and the rotary frame 52 are defined so that the pressure roller 43 is movable in the pressure roller-hole parts 523. This allows the pressure roller 43 to move relative to the rotary frame 52. In this manner, the rotary frame 52 supports the pressure roller 43, such that the pressure roller 43 can shake or rock, to thereby allow the pressure roller 43 to make contact with the driving roller 44 along the rotating shaft 441 of the driving roller 44 in a case that the rotary frame 52 is closed, even if the base part frame 51 and the rotary frame 52 are not accurately positioned with respect to each other. Therefore, it is possible to apply a nip pressure of the pressure roller 43 substantially uniformly with respect to the driving roller 44.

Further, according to the above-described configuration, in a case that the rotary frame 52 is closed, it is possible to stabilize the posture of the roller supporting part 61 supporting the pressure roller 43. Furthermore, as depicted in FIG. 3, in a case that the rotary frame 52 is closed, the two bearings 49 supporting both ends of the rotating shaft 441 of the driving roller 44 respectively are fitted to a first fitting claw 613A and a second fitting claw 613B, respectively, of the roller supporting part 61. Since the pressure roller 43 is movable relative to the rotary frame 52, the first fitting claw 613A and the second fitting claw 613B can be fitted to the bearings 49, respectively, even in a case that any distortion is generated in the rotary frame 52.

The driving roller 44 is driven on the basis of a control instruction from a controller (not depicted in the drawings) of the printing apparatus 1. In a closed state of the lid part 11, that is, in a closed state of the rotary frame 52, the pressure roller 43 presses the driving roller 44 and rotates by the driving of the driving roller 44. As a result, the pressure roller 43 and the driving roller 44 conveys the sheet S to the liquid discharging head 20 while holding (pinching) the sheet S therebetween.

<Locking Mechanism>

The printing apparatus 1 includes a locking mechanism configured to regulate a position of the rotary frame 52 relative to the base part frame 51 in a case that the rotary frame 52 is in the closed state. As depicted in FIGS. 2 and 3, the locking mechanism is provided on a side of the conveying direction D1 with respect to the roller supporting part 61, and includes a receiving part 53, a locking claw 54, a connecting part 55, a rotation shaft 56, a biasing member 57 and an operating lever 58. The receiving part 53 is connected to the base part frame 51, and the locking claw 54 and the connecting part 55 are connected to the rotary frame 52 via the rotation shaft 56.

The locking claw 54 is fixed to the receiving part 53 in the closed state of the rotary frame 52 to thereby regulate the position of the rotary frame 52 relative to the base part frame 51. The locking claw 54 is provided as locking claws 54 provided on the both ends, respectively, of the connecting part 55. The locking claws 54 are connected to the rotation shaft 56 and are swung (turned) via the rotation shaft 56 in a case that rotary frame 52 is opened and closed.

Figure 4:
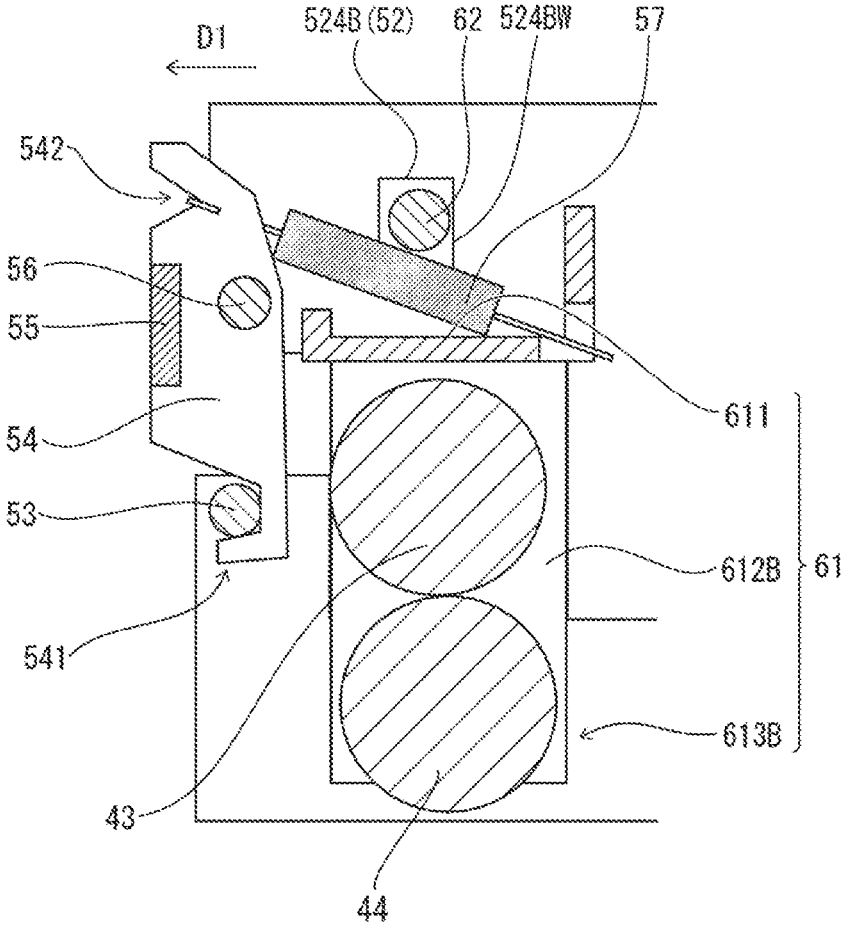
FIG. 4 is a cross-sectional view depicting the example of the peripheral structure of the pressure roller and the driving roller, cutting along a A-A line of FIG. 3.

As depicted in FIG. 4, each of the locking claws 54 includes a claw part 541 and a spring connection part 542. FIG. 4 is a cross-sectional view depicting an example of the peripheral structure of the pressure roller 43 and the driving roller 44, cutting along a A-A line of FIG. 3. The claw part 541 is fitted to the receiving part 53 in the closed state of the rotary frame 52. The biasing member 57 is connected to the spring connection part 542. The biasing member 57 is, for example, a spring of which one end is connected to the locking claw 54 and of which the other end is connected to the roller supporting part 61. With this connection, the biasing member 57 biases the roller supporting part 61 in the conveying direction D1 of the sheet S in the closed state of the rotary frame 52, that is, in a state that the pressure roller 43 and the driving roller 44 are brought into contact with each other.

Here, in a case that the sheet S is conveyed by the pressure roller 43 and the driving roller 44, the rotations thereof apply a force in the conveying direction D1 to the pressure roller 43 and driving roller 44. Since the biasing member 57 is provided, in the closed state of the rotary frame 52, the roller supporting part 61 supporting pressure roller 43 is biased in the conveying direction D1. Therefore, even in such a case that the force toward the conveying direction D1 is applied to the pressure roller 43 and the driving roller 44 and that the pressure roller 43 and the driving roller 44 are moved slightly in the conveying direction D1, it is possible to allow the roller supporting part 61 to follow such movement of the pressure roller 43 and the driving roller 44. Therefore, the relative position between the pressure roller 43 and the driving roller 44 can be maintained in a state that a possibility that any distortion might be generated in the roller supporting part 61, etc., is reduced, and a positioning of the pressure roller 43 relative to the driving roller 44 can be performed with high accuracy.

Further, the operating lever 58 which allows a user to manually move the locking claw 54 and the connecting part 55 about the axis of the rotation shaft 56 is provided on an end of the connecting part 55. By operating the operating lever 58, the user can release the regulation of the position of the rotary frame 52 relative to the base part frame 51.

<Roller Supporting Part 61, Supporting Part 62, and Biasing Member 63>

As depicted in FIG. 2 or FIG. 3, the lid part 11 includes the roller supporting part 61, a supporting part 62 and a biasing member 63.

As depicted in FIG. 3, the roller supporting part 61 includes: an extending part 611, a first supporting part 612A, a second supporting part 612B, the first fitting claw 613A, and the second fitting claw 613B.

The extending part 611 is a part extending in an extending direction of the pressure roller 43. The first supporting part 612A is a part which rotatably supports the one end (first end) of the rotating shaft 431 of the pressure roller 43 at one end (first end) of the extending part 611. The second supporting part 612B is a part which rotatably supports the other end (second end) of the rotating shaft 431 of the pressure roller 43 at the other end (second end) of the extending part 611. As depicted in FIG. 3, the one end of the rotating shaft 431 of the pressure roller 43 is connected to the first supporting part 612A via a bearing 48. The other end of the rotating shaft 431 of the pressure roller 43 is also connected to the second supporting part 612B via the bearing 48, similarly to the one end of the rotating shaft 431.

The first fitting claw 613B is a part which is provided on an end part of the first supporting part 612A and which is fitted into the bearing 49 provided on the one end (first end) of the rotating shaft 441 of the driving roller 44. The second fitting claw 613B is a part which is provided on an end part of the second supporting part 612B and which is fitted into the bearing 49 provided on the other end (second end) of the rotating shaft 441 of the driving roller 44. The first fitting claw 613B and the second fitting claw 613B are fitted into the bearings 49, respectively, in a case that the rotary frame 52 is closed. With this, the position of the pressure roller 43 with respect to the driving roller 44 is regulated. Note that the first fitting claw 613A and/or the second fitting claw 613B can be omitted. In such a configuration, the position of the pressure roller 43 with respect to the driving roller 44 may be regulated by fitting the first supporting part 612A without the first fitting claw 613A and/or the second supporting part 612B without the second fitting claw 613B into undepicted receiving part provided on the base part frame 51.

Note that it is allowable that the bearing 49 is not provided on each of the both ends of the rotating shaft 441 of the driving roller 44. In such a case, the first fitting claw 613A is fitted to the one end of the rotating shaft 441 of the driving roller 44 and the second fitting claw 613B is fitted to the other end of the rotating shaft 441 of the driving roller 44.

Figure 5:
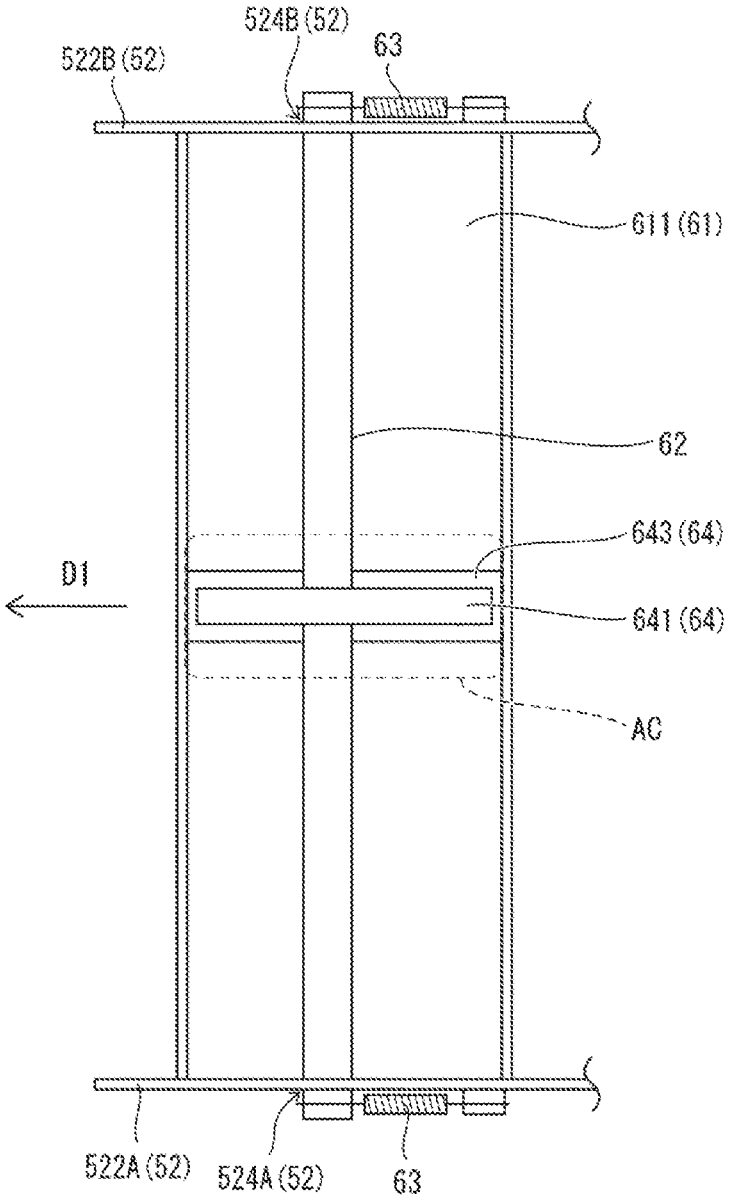
FIG. 5 is a plan view depicting an example of the peripheral structure of a roller supporting part.

As depicted in FIGS. 2 and 5, the supporting part 62 is connected to the first side surface part 522A and the second side surface part 522B of the rotary frame 52, and supports the pressing part 64. FIG. 5 is a plan view depicting an example of the peripheral structure of the roller supporting part 61. In FIG. 5, the locking mechanism is omitted in the illustration.

Specifically, the supporting part 62 is connected to the first side surface part 522A and the second side surface part 522B to be movable in a pressing direction D3 in which the pressure roller 43 is moved or directed toward the driving roller 44. In other words, the rotary frame 52 is an example of a "frame" which supports the supporting part 62 to be movable in the pressing direction D3. Further, the supporting part 62 is a stick-shaped member which extends along the extending direction of the extending part 611. The supporting part 62 is not limited to being the stick-shaped member, and may be a member having a shape capable of supporting the pressing part 64.

The biasing member 63 is a member which biases the supporting part 62 in the pressing direction D3, and is, for example, a spring. In this manner, since the lid part 11 is provided with the supporting part 62, the rotary frame 52 supporting the supporting part 62, and the biasing member 63, the lid part 11 is capable of applying a pressing force to the pressing part 64 for pressing, in the pressing direction D3, a central area AC of the extending part 611. This allows the pressing part 64 to press, in the pressing direction D3, the central area AC of the extending part 611.

As depicted in FIGS. 2 and 5, the biasing member 63 is provided on each of the first side surface part 522A and the second side surface part 522B of the rotary frame 52. One end of the biasing member 63 is connected to the first side surface part 522A and the other end of the biasing member 63 is connected to one end, of the supporting part 62, which penetrates through the first hole part 524A and projects to the outside of the rotary frame 52. Similarly, on the side of the second side surface part 522B, one end of the biasing member 63 is connected to the second side surface part 522B and the other end of the biasing member 63 is connected to the other end, of the supporting part 62, which penetrates through the second hole part 524B and projects to the outside of the rotary frame 52. As depicted in FIG. 2, each of the first hole part 524A and the second hole part 524B is greater than the cross-section of the supporting part 62.

In other words, the rotary frame 52 includes, as an example of the "first part", the first side surface part 522A having the first hole part 524A through which the one end (first end) in the extending direction of the supporting part 62 penetrates, and supporting the one end to be movable in the pressing direction D3. Further, the one end is connected to the first side surface part 522A via the biasing member 63. Furthermore, the rotary frame 52 includes, as an example of the "second part", the second side surface part 522B having the second hole part 524B through which the other end (second end) in the extending direction of the supporting part 62 penetrates, and supporting the other end to be movable in the pressing direction D3. Moreover, the other end is connected to the second side surface part 522B via the biasing member 63. This configuration allows the biasing member 63 to bias the pressing part 64 in the pressing direction D3 via the supporting part 62.

It is allowable that the biasing member 63 is provided only on the first side surface part 522A. Even in such a case, the biasing member 63 is capable of biasing the pressing part 64 via the supporting part 62. In such a case, the supporting part 62 is connected to the second side surface part 522B so that the supporting part 62 does not move in the pressing direction D3. That is, the second hole part 524B allows the other end of the supporting part 62 to penetrate therethrough and fixes the supporting part 62 to the second side surface part 522B.

Further, it is allowable that the biasing member 63 is provided only on the second side surface part 522B. In such a case, the second hole part 524B functions as the above-described first hole part and the second side surface part 522B functions as an example of the "first part". Furthermore, in such a case, the supporting part 62 is connected to the first side surface part 522A so that the supporting part 62 does not move in the pressing direction D3. That is, the first hole part 524A allows the one end of the supporting part 62 to penetrate therethrough and fixes the supporting part 62 to the first side surface part 522A.

As depicted in FIG. 2, the biasing member 63 is provided on the first side surface part 522A, with an expanding and contracting direction D2 of the biasing member 63 being inclined with respect to the pressing direction D3. According to this configuration, a component force of a biasing force of the biasing member 63 is generated in a substantially vertical direction with respect to the pressing direction D3 and in a direction reverse to the conveying direction D1. With this component force, the supporting part 62 can be brought into contact with an inner wall 524AW, of the first hole part 524A depicted in FIG. 2, which is on a side opposite to an inner wall, of the first hole part 524A, on a side of the conveying direction D1. Therefore, it is possible to reduce a shaking or rocking (shaking or rocking motion) of the supporting part 62 with respect to rotary frame 52 to thereby regulate the position of the supporting part 62 with respect to the rotary frame 52. Note that in the present embodiment, with respect to the biasing member 63 provided on the second side surface part 522B, the biasing member 63 is also provided so that the expanding and contracting direction D2 of the biasing member 63 is inclined with respect to the pressing direction D3. Therefore, similarly to the above-described configuration, the supporting part 62 can be brought into contact with an inner wall 524BW, of the second hole part 524B depicted in FIGS. 2 and 4, which is on a side opposite to an inner wall, of the second hole part 524B, on a side of the conveying direction D1.

<Specific Configuration of Pressing Part 64>

As depicted in FIG. 2, FIG. 3 and FIG. 5, the lid part 11 further includes the pressing part (pushing part) 64. The pressing part 64 presses (pushes) the central area AC of the extending part 611 depicted in FIG. 5 in the pressing direction D3 in a state that the pressure roller 43 and the driving roller 44 are brought into contact with each other. In the present embodiment, as described above, the biasing by the biasing member 63 with respect to the supporting part 62 causes the pressing part 64 to press the central area AC of the extending part 611 in the pressing direction D3.

According to this configuration, since a pressing force is applied to the central area AC, a force of about ½ of the pressing force can be applied to each of the both ends of the pressure roller 43 via the bearing 48 depicted in FIG. 3. Therefore, it is possible to reduce unevenness or variation which might be generated in the pressing force of the pressure roller 43 toward the driving roller 44. Therefore, the printing apparatus 1 is capable of conveying the sheet S from the pressure roller 43 and the driving roller 44 to the liquid discharging head 20 with high precision.

In a case that the printing apparatus is a label printer of the ink-jet printing system, a sheet S which is long is conveyed from the pressure roller 43 and the driving roller 44 to the liquid discharging head 20. In this case, if any unevenness or variation occurs in the pressing force, such an inconvenience that the sheet S is conveyed in a skewed manner, etc., easily occur. Thus, the printing apparatus according to the present disclosure is particularly useful for the above-described label printer.

In the present embodiment, a sum total of the biasing forces from the two biasing members 63 is applied to the pressing part 64, and is applied to the roller supporting part 61 as the pressing force from the pressing part 64. In a case that the pressing force can be applied to the central area AC, a force can be applied substantially uniformly to the respective both ends of the pressure roller 43 via the bearings 48 depicted in FIG. 3, and thus a nip pressure of the pressure roller 43 can be applied substantially uniformly with respect to the driving roller 44. In other words, the pressing force is applied to the central area AC by pressing part 64 in order to apply a substantially uniform force to the respective both ends of the pressure roller 43. Note that even in such a case that the biasing forces by the two biasing members 63 are not substantially uniform, the pressing force can be applied to the central area AC. That is, it is allowable that the elastic forces of the two biasing members 63 are different, or that the biasing member 63 is provided only on one of the first side surface part 522A and the second side surface part 522B.

The above-described central area AC is an area including a central part of the extending part 611 and a peripheral area of the central part, and is an area capable of applying a force substantially uniformly to the respective both ends of the pressure roller 43. The above-described central area AC is, for example, an area having a length which is not more than 50%, preferably not more than 20%, of the entire length of the extending part 611, and including a central part of the extending area 611.

In the present embodiment, as depicted in FIG. 2, FIG. 3 and FIG. 5, the one pressing part 64 is provided at one location that is the central part of the extending part 611. In this case, since the sum total of the biasing forces by the biasing members 63 is applied to the pressing part 64 provided at the one location in the central part, it is possible to press the roller supporting part 61 at the one location. Therefore, it is possible to apply the force to the pressure roller 43 more uniformly.

Figure 6:
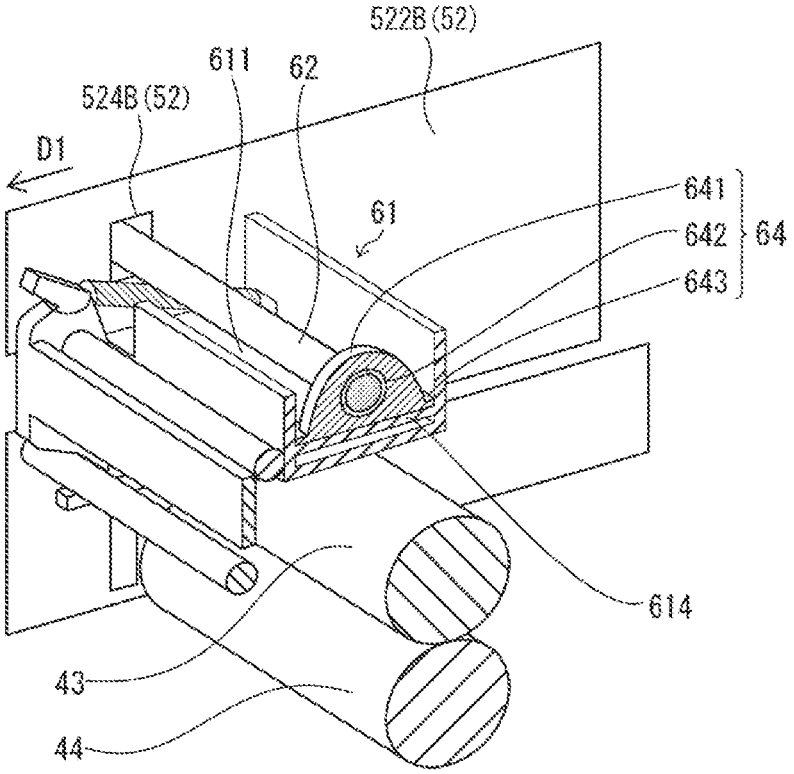
FIG. 6 is a perspective view depicting the example of the peripheral structure of the pressure roller and the driving roller, cutting along a B-B line of FIG. 3.
Figure 7B:
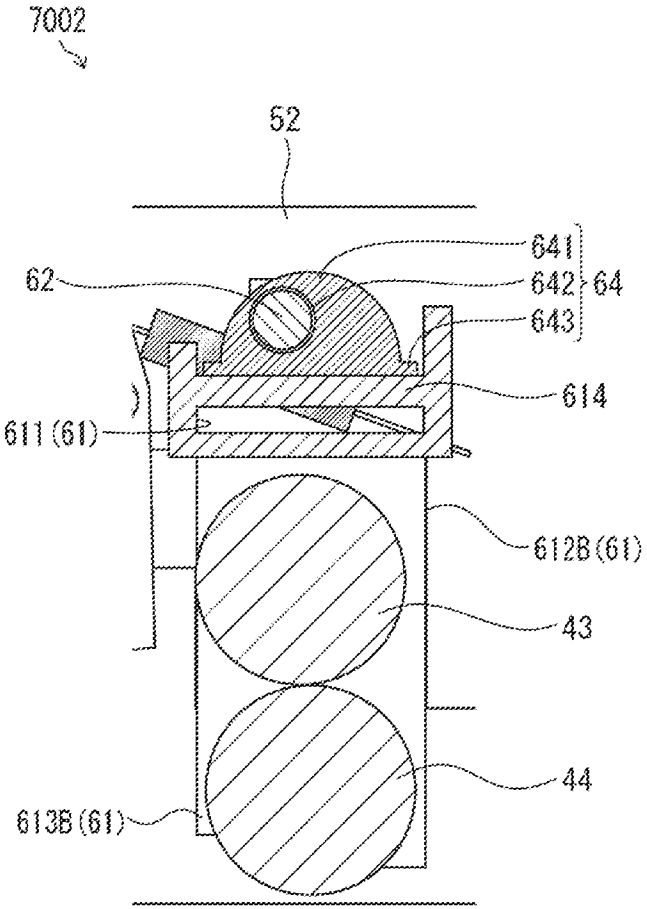
FIG. 7B is a cross-sectional view depicting the example of the peripheral structure of the pressure roller and the driving roller, cutting along the B-B line of FIG. 3.
Figure 7A:
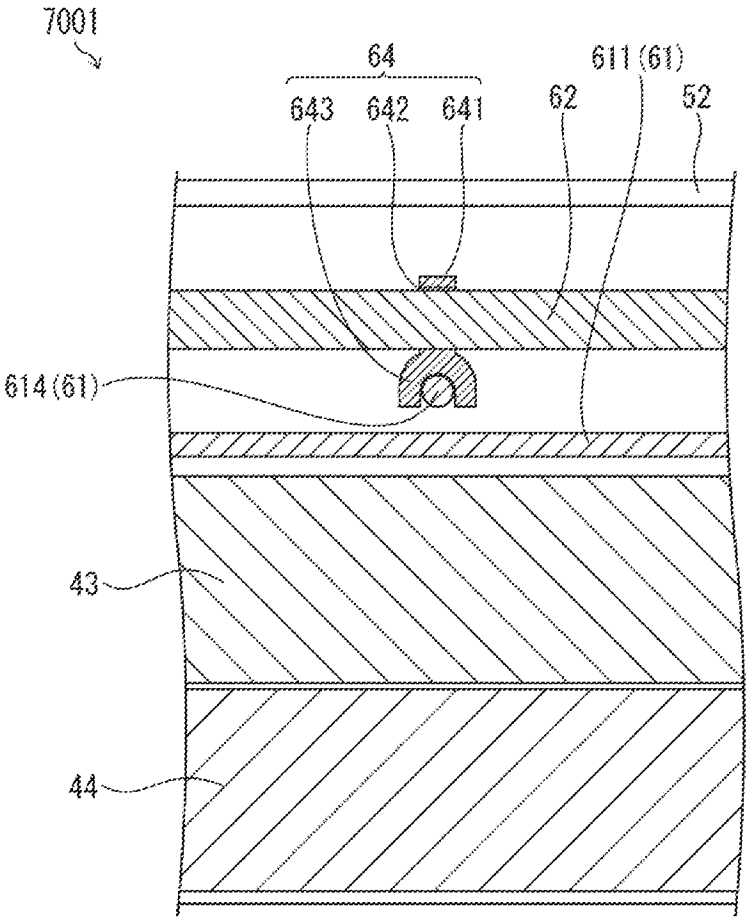
FIG. 7A is a cross-sectional view depicting the example of the peripheral structure of the pressure roller and the driving roller, cutting along a C-C line of FIG. 3.

Specifically, as depicted in FIG. 3 and FIGS. 5 to 7B, the pressing part 64 includes: a connecting part 641, a hole part 642, and a fitting part 643. FIG. 6 is a perspective view depicting an example of the peripheral structure of the pressure roller 43 and the driving roller 44, cutting along a line B-B of FIG. 3. Reference numeral 7001 in FIG. 7A is a cross-sectional view depicting an example of the peripheral structure of the pressure roller 43 and the driving roller 44, cutting along a C-C line of FIG. 3. Reference numeral 7002 of FIG. 7B is a cross-sectional view depicting an example of the peripheral structure of the pressure roller 43 and the driving roller 44, cutting along the B-B line of FIG. 3. Each of the cross-sectional views mainly depicts cross-sections of the pressing part 64 and the peripheral structure thereof.

The connecting part 641 is a part supported by the supporting part 62 and includes, as depicted in FIG. 6 and the reference numeral 7002 depicted in FIG. 7B, the hole part 642 which allows the supporting part 62 to penetrate therethrough. A gap is defined between the hole part 642 and the supporting part 62. That is, the hole part 642 is greater than the cross section of the supporting part 62. Therefore, the pressing part 64 is shakable or rockable with respect to the supporting part 62. With this, even in such a case that the supporting part 62 is in a state of being not substantially parallel to the rotating shaft 431 of the pressure roller 43 due to any distortion of the rotary frame 52, etc., it is possible to reduce such a possibility that a force generated due to the distortion, etc., might be transmitted from the supporting part 62 to the pressing part 64, owing to the shaking or rocking (shaking or rocking motion) of the pressing part 64 with respect to the supporting part 62. Therefore, even if the above-described state is provided, the pressing part 64 is capable of applying the force substantially uniformly to the respective both ends of the pressure roller 43. Therefore, even if the above-described state is provided, the pressure roller 43 is capable of pressing the driving roller 44 while maintaining the state in which the rotating shaft 431 of the pressure roller 43 and the rotating shaft 441 of the driving roller 44 are substantially parallel to each other. Note that, however, even in such a case that the above-described gap is not defined or formed and that the size of the hole part 642 is same as the cross section of the supporting part 62, the pressing part 64 is capable of applying the force substantially uniformly to the respective both ends of the pressure roller 43.

The fitting part 643 is provided at a lower end of the connecting part 641 and is fitted to a shaft part 614 provided on the roller supporting part 61. The shaft part 614 is a member supporting the pressing part 64. Specifically, the shaft part 614 is provided on a central part of the extending part 611 and extends in the conveying direction D1. The fitting part 643 and the shaft part 614 are an example of the pressing part 64 provided on the roller supporting part 61 so as to be swingable with respect to the roller supporting part 61. Also in such a configuration in which the pressing part 64 is provided so as to be swingable, and even in such a case that the supporting part 62 is in a state that the supporting part 62 is not substantially parallel to the rotating shaft 431 of the pressure roller 43, the pressing part 64 is capable of applying a force substantially uniformly to the respective both ends of the pressure roller 43. Therefore, even in in a case that the above-described state is provided, the pressure roller 43 is capable of pressing the driving roller 44 while maintaining the state in which the rotating shaft 431 of the pressure roller 43 and the rotating shaft 441 of the driving roller 44 are substantially parallel to each other. Note, however, that the fitting part 643 is fitted to the shaft part 614 so as not to move in the conveying direction D1, as depicted in FIG. 6. Further, even in a case that the pressing part 64 is fixed to the extending part 611, the pressing part 43 is capable of applying the force substantially uniformly to the respective both ends of the pressure roller 43. Note that in this case, it is not necessary that the pressing part 64 is provided with the fitting part 643, and it is not necessary that the extending part 611 is provided with the shaft part 614.

Furthermore, in the present embodiment, the one pressing part 64 is supported by the supporting part 62 in the central part, of the supporting part 62, which faces the central part of the extending part 611. The central part of the supporting part 62 is an example of "one location" in the central area of the supporting part 62.

For example, even in a case that the pressing part 64 is connected at one location in the roller supporting part 61, in a case that the pressing part 64 is supported at a plurality of locations in the supporting part 62, the pressing force is applied from the plurality of locations to the pressing part 64. In a case that any distortion occurs in the rotary frame 52, there is such a possibility that the position of the supporting part 62 might be deviated in the conveying direction D1, due to the distortion. In such a case, since the magnitudes of the pressing forces applied from the plurality of locations, respectively, to the pressing part 64 might be different among the plurality of locations, there is such a possibility that the roller supporting part 61 might be twisted in the conveying direction D1. Since the roller supporting part 61 supports the pressure roller 43, there is such a possibility that any twisting of the roller supporting part 61 might reduce the positioning precision or accuracy of the pressure roller 43 with respect to the driving roller 44.

According to the above-described configuration, even if any distortion occurs in the rotary frame 52, it is possible to reduce the above-described possibility that the roller supporting part 61 might be twisted. Therefore, even in a case that the pressing part 64 is provided on the supporting part 62, the printing apparatus 1 is capable of suppressing any deterioration in the positioning accuracy.

<Modification of Pressing Part 64>

Figure 8A:
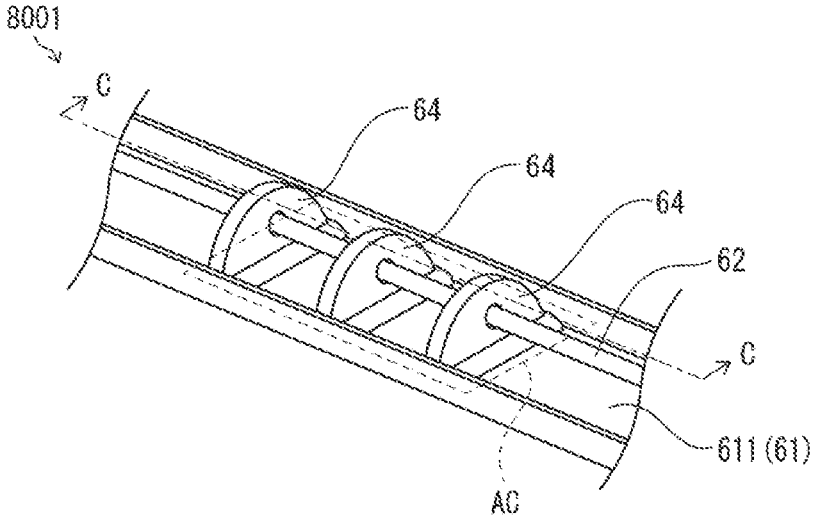
FIGS. 8A and 8B are each a view depicting a modification of a pressing part.
Figure 8B:
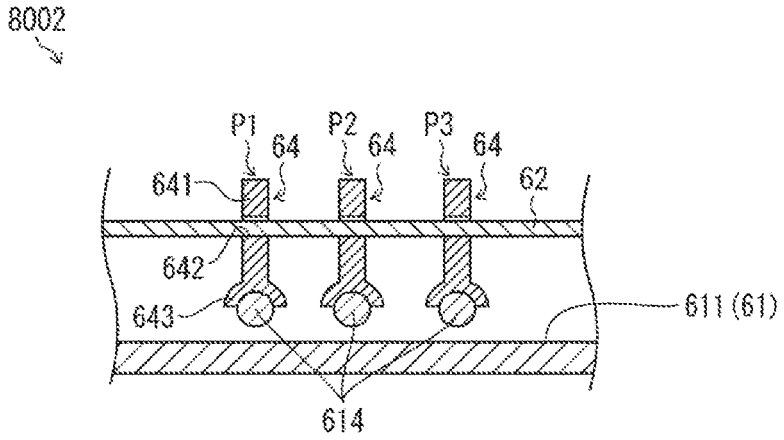
Figure 9A:
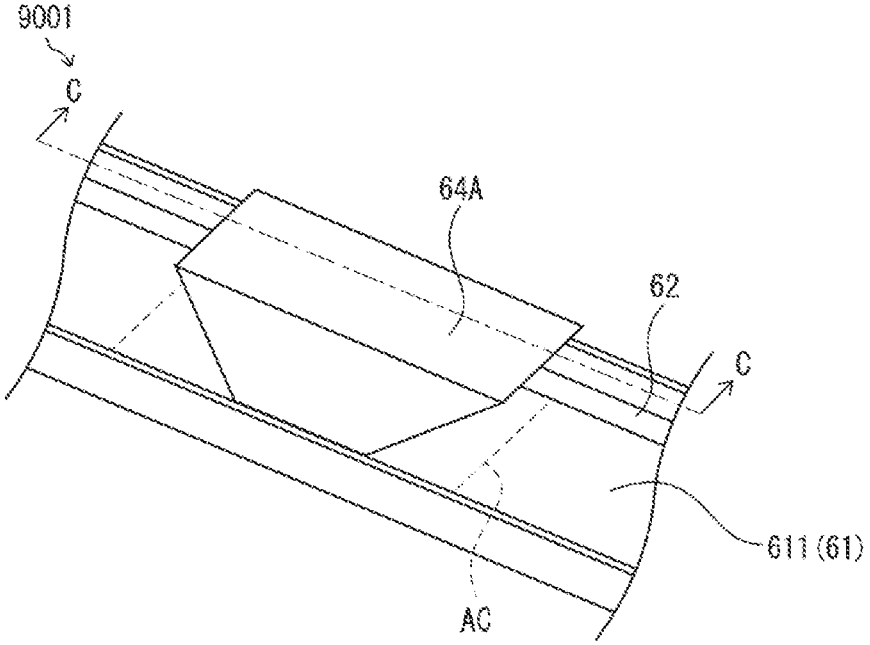
FIGS. 9A and 9B are each a view depicting a modification of the pressing part.
Figure 9B:
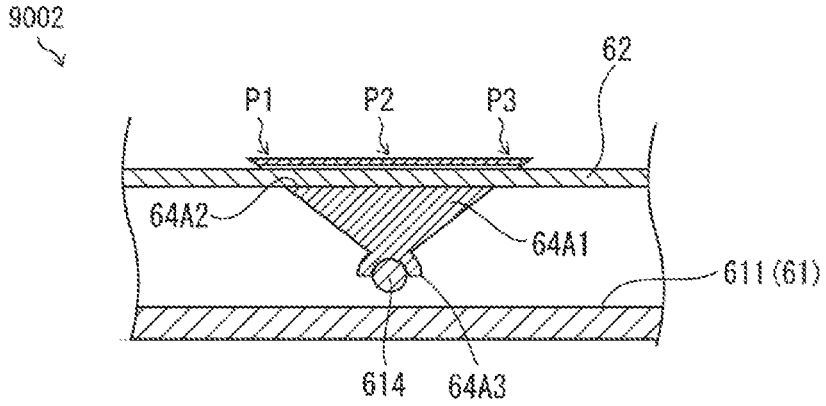

FIGS. 8A and 8B and FIGS. 9A and 9B are each a view depicting a modification of the pressing part 64. A reference numeral 8001 of FIG. 8A is a perspective view depicting an example of the roller supporting part 61 in the vicinity of the central area AC of the extending part 611; and a reference numeral 8002 of FIG. 8B is a cross-sectional view, cutting along the C-C line in FIG. 8A. A reference numeral 9001 of FIG. 9A is a perspective view depicting another example of the roller supporting part 61 in the vicinity of the central area AC of the extending part 611, and a reference numeral 9002 of FIG. 9B is a cross-sectional view, cutting along the C-C line in FIG. 9A.

As depicted in FIGS. 8A and 8B, a plurality of pressing parts 64 may be provided on the central area AC of the extending part 611. In this case, the extending part 611 is provided with a plurality of shaft parts 614 configured to support the plurality of pressing parts 64, respectively; and a fitting part 643 of one of the plurality of pressing parts 64 is fitted shakably to each of the plurality of shaft parts 614.

In the example depicted in FIGS. 8A and 8B, one piece of the pressing part 64 is provided at a position P2 in the central area AC, and two pieces of the pressing part 64 are provided at positions P1 and P3, respectively, in the central area AC. The position P2 is a position corresponding to the central part of the roller supporting part 61.

Also in this configuration, since it is possible to press the central area AC of the extending part 611, it is possible to reduce the occurrence of any unevenness or variation in the pressing force from the pressure roller 43 to the driving roller 44. Note, however, that since the pressing parts 64 are provided at the positions P1 and P3, respectively, which are separated away from the position P2 which is the central part of the extending part 611, any unevenness or variation in the pressing force pressing the roller supporting part 61 might occur, as compared with a case in which the pressing part 64 is provided only in the central part. From this viewpoint, it is more preferable that the pressing part 64 is provided on one location in the central part.

Note that it is allowable that two pieces or not less than four pieces of the pressing part 64 are provided on the central area AC. That is, it is allowable that at least one pressing part 64, as the pressing part 64 configured to press the central area Ac, is provided on the extending part 611.

Further, as depicted in FIGS. 9A and 9B, a pressing part 64A which is supported at a plurality of locations in the supporting part 62 may have a configuration wherein one piece of such a pressing part 64A is provided on the central area AC of the extending part 611.

The pressing part 64A, similarly to the pressing part 64, includes: (1) a connection part 64A1 connectable to the supporting part 62; (2) a hole part 64A2 which allows the supporting part 62 to penetrate therethrough and which has a cross section greater than the cross section of the supporting part 62; and (3) a fitting part 64A3 fittable to the shaft part 614.

Note, however, that the connection part 64A1 is different from the connecting part 641 of the pressing part 64 in that the connection part 64A1 has a three-dimensional shape wherein the connection part 64A1 is supported at a plurality of locations in the supporting part 62 and the connecting part 64A1 is connected to the one fitting part 64A3 at a lower end part of the connection part 64A1. In the example depicted in FIGS. 9A and 9B, the pressing part 64A is supported by the supporting part 62 via the connection part 64A1 at a position P2 which is the central part of the extending part 611, and at other positions, of the central area AC, e.g. at the positions P1 and P3, which are different from the position P2.

Also in this configuration, since the central area AC of the extending part 611 can be pressed, it is possible to reduce any unevenness or variation that might occur in the pressing force from the pressure roller 43 to the driving roller 44. Note, however, that the pressing part 64A is supported by the supporting part 62 at the positions P1 and P3 which are separated away from the position P2 which is the central part of the extending part 611. Therefore, as described above, in a case that the rotary frame 52 is distorted, there is such a possibility that the roller supporting part 61 might be twisted, and that the positioning accuracy of the pressure roller 43 with respect to the driving roller 44 might be lowered. From this viewpoint, it is more preferable to adopt, as the pressing part, the pressing part 64 provided on one location in the central part, but it is not limited thererto. It should be noted that in a case that any distortion occurs in the rotary frame 52, the roller supporting part 61 might be twisted as described above. It might occur in a similar manner also in the configuration as depicted in FIGS. 8A and 8B wherein the pressing parts 64 are connected to the plurality of locations, respectively, in the roller supporting part 61.

Second Embodiment

Another embodiment of the present disclosure will be described below. For the convenience of explanation, members having the same functions as those of the members explained in the above-described embodiment are denoted by same reference numerals, and the explanation thereof will not be repeated.

Figure 10:
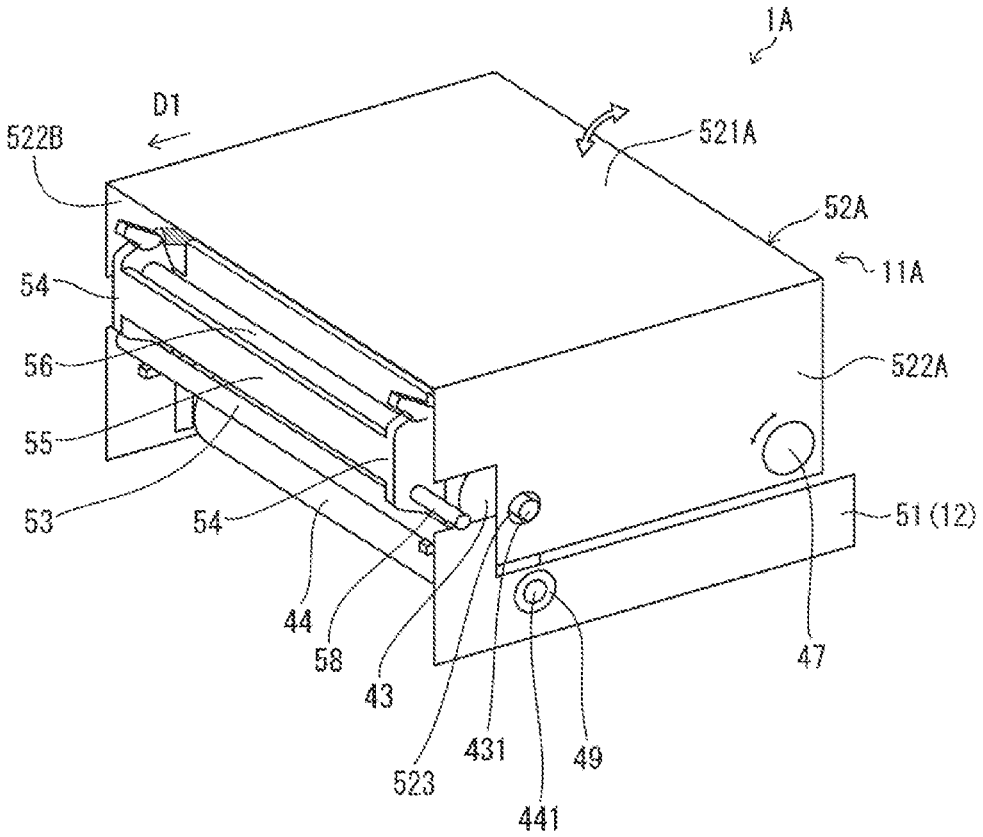
FIG. 10 is a perspective view depicting an example of the peripheral structure of a pressure roller and a driving roller of a printing apparatus according to a second embodiment.

FIG. 10 is a perspective view depicting an example of the peripheral structure of a pressure roller 43 and a driving roller 44 of a printing apparatus 1A relating to a second embodiment of the present disclosure. As depicted in FIG. 10, in the printing apparatus 1A, a lid part 11A is different from the lid part 11 in that the lid part 11A includes a rotary frame 52A. The rotary frame 52A is different from the rotary frame 52 in that the rotary frame 52A includes a upper surface part 521A. The upper surface part 521A is different from the upper surface part 521 in that the upper surface part 521A extends up to a location above or on the upper side of the pressure roller 43 and the driving roller 44 so as to cover the pressure roller 43 and the driving roller 44.

Note, however that as depicted in FIG. 10, the rotary frame 52A shakably or rockably supports the pressure roller 43, similarly to the rotary frame 52. Specifically, the first side surface part 522A is provided with a pressure roller-hole part 523 through which one end of the rotating shaft 431 of the pressure roller 43 penetrates, and the second side surface part 522B is provided with a pressure roller-hole part 523 through which the other end of the rotating shaft 431 of the pressure roller 43 penetrates. These two pressure roller-hole parts 523 are greater than the cross-section of the rotating shaft 431 of the pressure roller 43.

Figure 11:
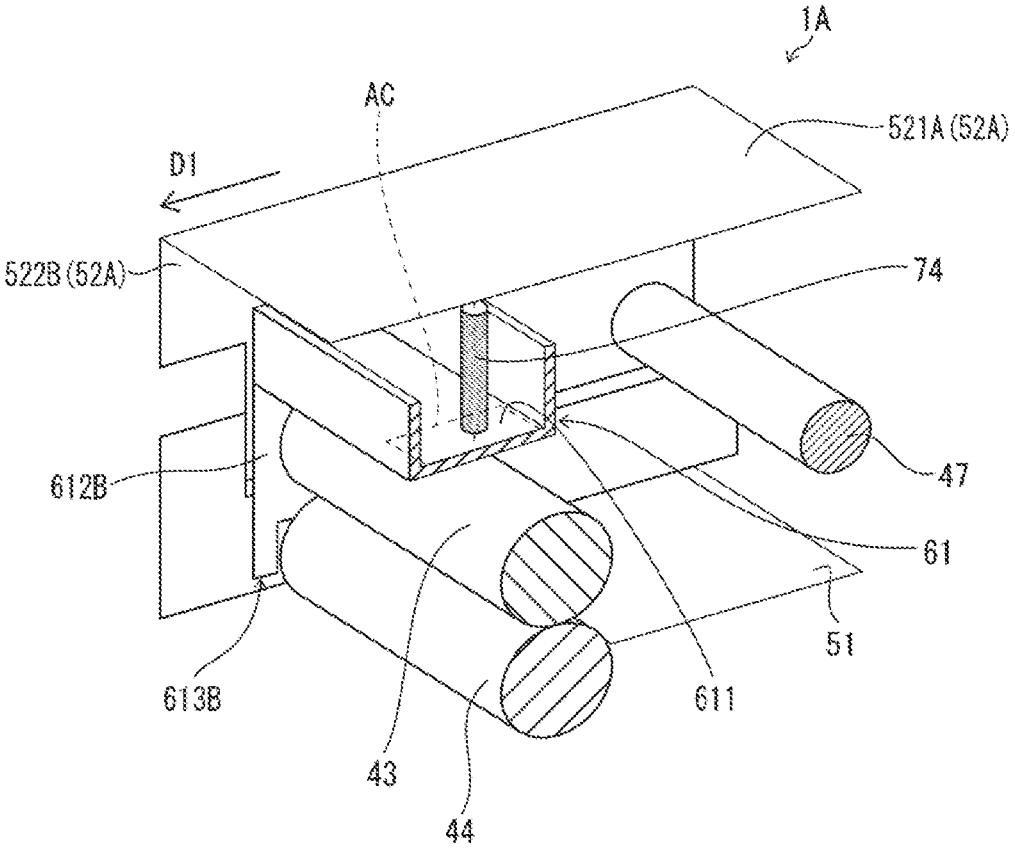
FIG. 11 is a view depicting an example of a pressing part according to the second embodiment.

Further, as depicted in FIG. 11, the printing apparatus 1A is provided with a pressing part 74. FIG. 11 is a view depicting an example of the pressing part 74. In FIG. 11, the illustration of the locking mechanism is omitted. The pressing part 74 is different from the pressing parts 64 and 64A in that the pressing part 74 is connected to a central area AC of an extending part 611 and to an upper surface part 521A, which is an example of a part, of lid part 11A, facing the extending part 611. Also with this configuration, it is possible to apply a substantially uniform force to the respective both ends of the pressure roller 43, via the bearings 48 as depicted in FIG. 3, in the closed state of rotary frame 52. Therefore, similarly to the pressing part 64, the printing apparatus 1A is capable of accurately conveying the sheet S from the pressure roller 43 and the driving roller 44 to the liquid discharging head 20.

The pressing part 74 is, for example, a biasing member such as a spring, etc. By using the biasing member as the pressing part 74, the pressing part 74 is capable of applying, to the central area AC of the extending part 611, a biasing force generated in the closed state of the rotary frame 52, as the pressing force from the pressing part 74. Note that similarly to the pressing part 64, it is allowable that a plurality of pieces of the pressing part 74 are provided on the central area AC.

According to the printing apparatus relating to the above-described embodiments, it is possible to convey the sheet with high accuracy by the first conveying roller and the second conveying roller.

ADDITIONAL NOTES

The present invention is not limited to each of the embodiments as described above, and various changes can be made within the scope of the claims; an embodiment which is obtained by appropriately combining the technical means disclosed in each of the different embodiments is also encompassed in the technical scope of the present invention.

What is claimed is:

1. A printing apparatus comprising:

a recorder configured to record an image on a sheet;

a first conveying roller and a second conveying roller configured to convey the sheet to the recorder while pinching the sheet therebetween;

a lid in which the first conveying roller is supported; and a main body in which the second conveying roller is supported, wherein the lid includes:

a roller support which supports the first conveying roller, and which is configured to regulate the position of the first conveying roller with respect to the second conveying roller while the first conveying roller and the second conveying roller pinch the sheet therebetween, the roller support including:

an extending part which extends in an extending direction of a rotation shaft of the first conveying roller, a first support which supports a first end of the rotation shaft of the first conveying roller, at a first end of the extending part, a second support which supports a second end of the rotation shaft of the first conveying roller, at a second end of the extending part;

and at least one pressing part configured to press a central area of the extending part in a pressing direction extending from the first conveying roller to the second conveying roller, in a state that the first conveying roller and the second conveying roller contact with each other, and the roller support is configured to regulate the position of the first conveying roller with respect to the second conveying roller by fitting an end part of the first support and an end part of the second support to a rotation shaft of the second conveying roller.

2. The printing apparatus according to claim 1, wherein a roller support has:

a first fitting claw provided on the end part of the first support and configured to fit to a first end of the rotation shaft of the second conveying roller or a bearing provided on the first end of the rotation shaft of the second conveying roller, and a second fitting claw provided on the end part of the second support and configured to fit to a second end of the rotation shaft of the second conveying roller or a bearing provided on the second end of the rotation shaft of the second conveying roller.

3. The printing apparatus according to claim 1, wherein the pressing part is swingable with respect to the extending part.

4. The printing apparatus according to claim 3, wherein the extending part includes a shaft configured to support the pressing part; and the pressing part includes a fitting part fitted to the shaft.

5. The printing apparatus according to claim 1, wherein the lid includes:

a support which supports the pressing part;

a frame which supports the support to be movable in the pressing direction; and a biasing member configured to bias the support in the pressing direction.

6. The printing apparatus according to claim 5, wherein a hole, through which the support penetrates, is provided in the pressing part; and a gap is defined between a surface defining the hole and the support.

7. The printing apparatus according to claim 5, wherein the pressing part is provided at a single location in the extending part as a solo pressing part of the printing apparatus; and the support supports the pressing part at a single location in the central area of the support, the single location in the central area of the support faces the single location in the extending part.

8. The printing apparatus according to claim 5, wherein the support extends in the extending direction;

the frame includes a first part in which a first hole through which a first end in the extending direction of the support penetrates is provided, and which supports the first end in the extending direction of the support to be movable in the pressing direction; and the first end in the extending direction of the support is connected to the first part via the biasing member.

9. The printing apparatus according to claim 8, wherein the biasing member is provided on the first part such that an expanding and contracting direction of the biasing member is inclined with respect to the pressing direction.

10. The printing apparatus according to claim 8, wherein the frame includes a second part having a second hole through which a second end in the extending direction of the support penetrates, and which supports the second end in the extending direction of the support to be movable in the pressing direction; and the second end in the extending direction of the support is connected to the second part via the biasing member.

11. The printing apparatus according to claim 1, wherein the pressing part is connected to the central area of the extending part and to a part, of the lid, which faces the extending part.

12. The printing apparatus according to claim 1, wherein the lid includes a frame having:

a first part in which a third hole through which the first end of the rotation shaft of the first conveying roller penetrates is provided, and which movably supports the first end of the rotation shaft of the first conveying roller; and a second part in which a fourth hole through which the second end of the rotation shaft of the first conveying roller penetrates is provided, and which movably supports the second end of the rotation shaft of the first conveying roller.

13. The printing apparatus according to claim 1, comprising a biasing member configured to bias the roller support in a conveying direction of the sheet in the state that the first conveying roller and the second conveying roller are brought into contact with each other.

14. The printing apparatus according to claim 1, wherein the recorder is a liquid discharging head configured to discharge a liquid to the sheet.

15. The printing apparatus according to claim 1, wherein the lid is swingable relative to the main body.

* * * * *